US007165271B2

(12) United States Patent
Elen

(10) Patent No.: US 7,165,271 B2
(45) Date of Patent: Jan. 23, 2007

(54) TRANSFORMABLE GARMENT

(76) Inventor: Carine O. R. Elen, 206 Greycourt Rd., Chester, NY (US) 10918

( * ) Notice: Subject to any disclaimer, the term of this patent is extended or adjusted under 35 U.S.C. 154(b) by 435 days.

(21) Appl. No.: 10/420,597

(22) Filed: Apr. 22, 2003

(65) Prior Publication Data

US 2006/0000004 A1 Jan. 5, 2006

(51) Int. Cl.
*A41D 3/02* (2006.01)

(52) U.S. Cl. ..... 2/85; 2/86; 2/301; 2/93; 224/153

(58) Field of Classification Search ..... 2/86, 2/301, 85; 224/153
See application file for complete search history.

(56) References Cited

U.S. PATENT DOCUMENTS 2,146,243 A * 2/1939 Aug ..... 2/85
2,248,455 A * 7/1941 Freund ..... 2/94
2,620,479 A * 12/1952 Buck ..... 2/94
4,347,629 A * 9/1982 Itoi ..... 2/108
4,404,687 A * 9/1983 Hager ..... 2/94
4,502,155 A * 3/1985 Itoi ..... 2/115
5,165,111 A * 11/1992 Lieberman ..... 2/94
5,699,560 A * 12/1997 Greenberg ..... 2/94
5,815,833 A * 10/1998 Kuo ..... 2/69.5
5,860,164 A * 1/1999 Johnson ..... 2/94
6,405,377 B1 * 6/2002 Davis ..... 2/94
6,421,834 B1 * 7/2002 Kester ..... 2/94
6,874,162 B1 * 4/2005 Boezi ..... 2/84
2003/0205593 A1 * 11/2003 Lavelle ..... 224/153
2005/0056669 A1 * 3/2005 Lavelle ..... 224/153
2005/0091724 A1 * 5/2005 Snyder et al. ..... 2/86

* cited by examiner

*Primary Examiner*—Katherine Moran
*Assistant Examiner*—Richale L. Haney
(74) *Attorney, Agent, or Firm*—Hosmer & Reiter; Howard S. Reiter

(57) ABSTRACT

An upper torso garment, such as a jacket, can be folded within itself to transform it into a different shape for use as a pillow. In a further embodiment, the garment bears an integral back pack which can be used while the garment is being worn, and can be transformed into either the pillow shape or into a wearable back pack, with the garment structure fully contained and concealed in both of these configurations. The garment includes a flap element an integral hinge portion and separable fastener halves, e.g. zipper half sections, mounted to permit various parts of the garment to be fastened together in varying relative configurations by fastening one half section to various other mating half sections located on different parts of the garment.

8 Claims, 7 Drawing Sheets

TRANSFORMABLE GARMENT

BACKGROUND OF THE INVENTION

1. Field of the Invention

This invention relates generally to outerwear garments worn by children and adults, and more specifically relates to jacket-like upper torso garments capable of being integrally transformed in shape to serve other functions. Outerwear garments capable of being transformed by addition or removal of various parts have been known for many years. For example, many jacket and coat-like garments have incorporated removable inner lining elements to accommodate seasonal changes in outdoor temperature. Other garments, including jackets and pants have incorporated removable arm and leg portions for converting long sleeve shirts and jackets, and long pants, into short sleeve and short leg versions similarly intended to accommodate the wearer to seasonal weather changes. However, an outerwear garment specifically adapted to accommodate the current popularity of so-called back packs and waist packs, and the desirability of an inexpensive and convenient way to store and transport an outwear garment, especially when it cannot be allowed to remain in a fixed location apart from the person responsible for it, is believed not to have been known or available previously.

2. Description of the Invention

Although the garment of the present invention is suitable for use by both children and adults, it will be recognized readily that the embodiment herein disclosed is particularly suited to meet the requirements of children and young adults. The disclosed embodiment comprises an outerwear garment intended to be worn on the upper torso of a person.

The garment may be jacket-length or longer, and may be sleeveless or may incorporate long or short sleeves, without affecting or departing from the spirit and operation of the invention. When the garment is not being worm, for example in an indoor environment, or when ambient outdoor conditions make it desirable to remove a shirt or jacket, the garment of this invention can be transformed readily into a self-contained package in the form of a portable cushion, or, the garment may have a back pack assembly separably or integrally attached and may be transformed into a wearable back pack with the structural elements of the garment stored out-of-sight as part of the resulting assembly package.

SUMMARY OF THE INVENTION

As disclosed herein, a garment in accordance with the invention has a shirt or jacket-like form of substantially conventional appearance. In a preferred form, a back-pack assembly of similarly conventional configuration is attached to the outer back surface of the garment in substantially the same physical location that a back pack would ordinarily occupy relative to the back of a wearer. The assembly may be separably or integrally attached to the garment in any suitable, known manner. On the inner back surface of the garment, adjacent the back of a wearer, a fabric flap is attached in hinge-like relationship near the neck opening. The periphery of the flap is separably fastened to the inner back surface of the garment by a continuous separable fastener, such as a zipper or a "hook-and-loop" device of the type sold under the trademark "Velcro". That is, a first half-section of the separable fastener is attached to the outer periphery of the flap, and a second half-section is attached to the inner back of the garment so as to fasten the flap in a first position with one surface of the flap in opposed relationship with the inner surface of the back of the garment. A third half section of a separable fastener is attached to the outer back surface of the garment surrounding most of the outer periphery of the back pack assembly. This third fastener portion is substantially identical to the second half-section that is attached to the inner back surface of the garment.

Accordingly, the first fastener half, attached to the fabric flap, is capable of engaging either one of the second and third fastener half portions. Moreover, the first fastener half is "reversible" in nature, in that it may be engaged with either one of the other fastener halves regardless of whether it approaches the other halves from the inner or outer sides of the garment. In this regard it should be understood that the flap member may be hingedly displaced from its first position, wherein one surface of the flap is disposed in opposed relationship with the inner surface of the back of the garment, to a second position wherein the second surface of the flap is disposed in opposed relationship with the outer back surface of the garment. And, it is important to note that the flap can be separably fastened selectively to either the inner or the outer back surfaces of the garment, while the flap is positioned in opposed relationship with either the inner or outer side of the garment.

Transformation of the garment into a self-stored cushion configuration is achieved by hingedly displacing the hinged flap from its first position facing the inner back surface of the garment, to its second position facing the outer back of the garment, folding the bulk of the garment structure over the outer back of the garment so that it lies between the outer back and the opposed face of the flap, and then engaging the first fastener half-portion [the one on the flap] with the second fastener half-section that is mounted to the inner back of the garment. Although the flap is positioned on the exterior of the garment, the fastener on the flap is engaged with the fastener on the inner surface of the garment because the fastener half on the outer surface is covered over, in this case, by the folded-over portions of the garment.

It should be understood in this regard, that when the flap is engaged in this orientation, the inner surface of the back of the garment and the inner surface of the flap are exposed to become the outer surfaces of the resulting package, i.e. the "cushion" shape. Accordingly, these two normally unexposed surfaces may be treated or selected to have characteristics particularly suited for use or service as a cushion or pillow.

Conversely, transformation of the garment from its "as-worn" garment-configuration, into a wearable back-pack, having the structural elements of the garment stored out-of-sight, is achieved by separating [unfastening] the fabric flap from the inner back folding the bulk of the garment structure over the inner back of the garment, so that it lies between the first surface of the flap and the inner back surface of the garment, and then securing the first fastener portion [the one attached to the flap] to the third fastener portion [the one mounted to the outer back of the garment]. Fastening the fastener half-section of the flap to the mating fastener half-section on the outer back of the garment completes the garment-to-wearable-back-pack conversion, by enclosing the garment structure within the "pocket" defined between the flap and the inner back surface of the garment, while leaving the back pack assembly exposed for use. The flap fastener portion is engaged to the outer back fastener half because the fastener half on the inner back is covered over by the folded-over portions of the garment.

Carrying straps for wearing and using the back pack independently of the garment configuration, are usually stored in the "pocket" defined between the flap and the inner back surface of the garment, until that pocket is opened and the straps are exposed preparatory to converting the garment to its back pack [or cushion] configuration.

These and other and further objects, features and advantages of the disclosed invention will be distinctly pointed out in the following claims, and will be made obvious to those having skill in the related arts, by the following specification considered in association with the accompanying drawings, in which:

DETAILED DESCRIPTION OF THE PREFERRED EMBODIMENT

Figure 1:
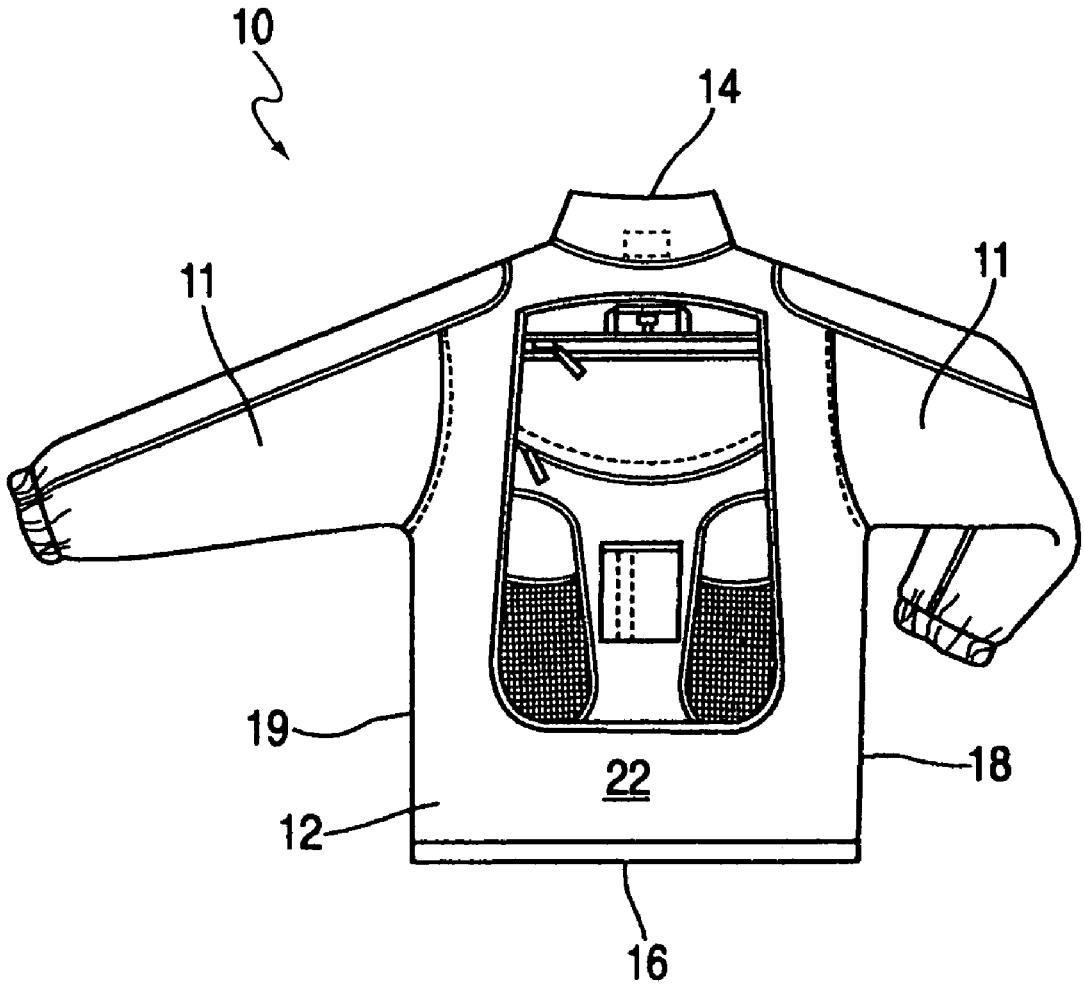
FIG. 1 is rear pictorial view of a jacket garment in accordance with this invention, with a back-pack structure on the outer back thereof.

Referring now more particularly to the drawings, the garment 10 of this invention may be seen to comprise a jacket-like garment having a back portion 12, formed of garment fabric, having a first edge 14, a second edge 16 substantially oppositely disposed and spaced from said first edge, a left side 18 and a right side 19, an inner surface 20, and an outer surface 22 (see FIG. 1) on the reverse side of inner surface 20. A plurality of conventional garment structural portions, such as sleeves 11 and right and left side portions 24, 25, are attached to and/or extend from, back portion 12. A first open section 26 along the first edge 14 of the garment back portion 12, defines the neck or collar opening of the garment, between said first forwardly extending front side portion 24 and said second forwardly extending front side portion 25.

A fabric flap member 28 having an inner first surface 30 and an outer second surface 32, is hingedly attached to the back portion 12 of the garment along a first, flexible hinge portion 34 on its outer periphery 36. Although hinge portion 34 is shown attached to back portion 12 proximate neck opening 26, those skilled in this art will recognize that hinge portion 34 may be attached elsewhere, for example, proximate the second, or bottom edge 16 of back portion 12, without departing from the spirit and scope of this disclosure. Substantially all of the remaining portion 38 of the periphery 36 of flap member 28 is separably fastened to the inner surface 20 of back portion 12 by a separable fastener 40 such as a zipper or hook-and-loop fastener of the type widely sold under the trademark Velcro. Two open portions 35 of periphery 36, flanking hinge portion 34, remain free of attachment to back portion 12 for reasons explained elsewhere herein.

A first half-portion 42 of fastener 40 is secured to the periphery 36 of flap 28. A second, mating fastener half-portion 44 is attached to the inner surface 20 of back portion 12 in position to engage fastener half portion 42 so as to separably fasten flap 28 to the inner surface 20 of back 12. In this first position, flap member 28 and the inner surface 20 of back portion 12 form a "pocket" between them. As made apparent by the drawings, in this relationship, the inner surface 30 of flap 28 is disposed in opposed relationship with the underlying area of inner back surface 20 [see FIG. 8, where fastener half portions 42, 44 are shown just after the portions have been unfastened].

When fastener elements 42, 44 are separated or disengaged, fabric flap member 28 may be displaced flexibly about hinge 34 from its first position, with inner surface 30 in opposed relationship with inner back surface 20, to a second position, in which outer, second surface 32 of flap 28 is disposed in opposed relationship with outer back surface 22 of back portion 12.

Figure 6:
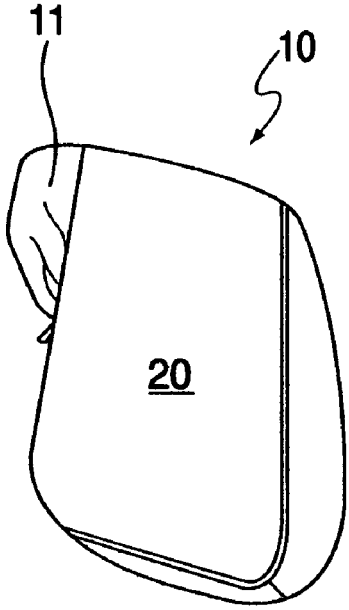
FIG. 6 is pictorial representation of the garment of FIG. 5, shown substantially fully transformed into a self-contained cushion or pillow configuration.
Figure 10:
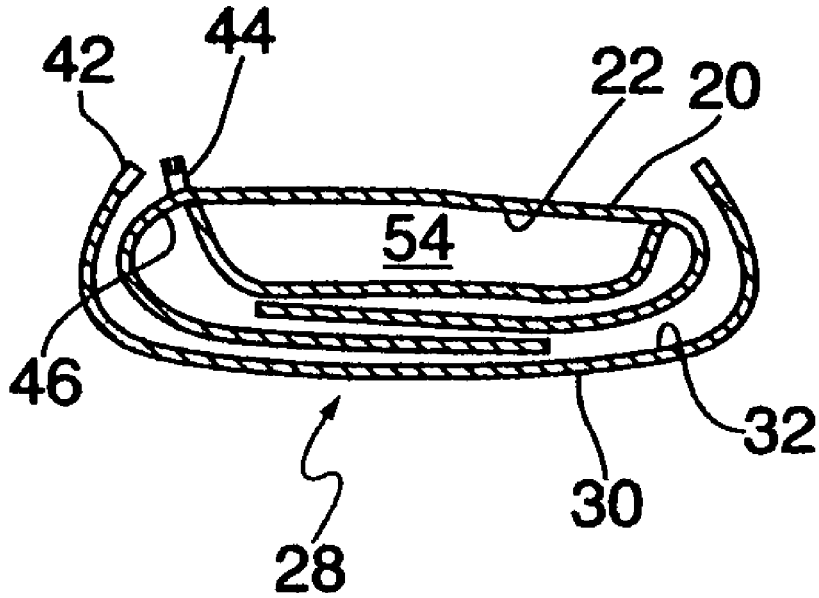
FIG. 10 is a schematic transverse section view of the garment of FIG. 6 showing how the back, flap and bulk of the garment are disposed when the garment has been transformed into a self-contained cushion package

In this second position, fabric flap member 28 defines a second fabric pocket between the opposed exterior back surface 22 of garment 10 and the outer surface 32 of flap 28 [see FIG. 10]. It is a feature of this invention that first fastener half-portion 42 engages fastener half-section 44 in this second position, as well as in the first position, described above. In this second position, flap 28 is disposed in overlying relationship with the outer back surface 22 of back portion 12 and the structural elements of the garment may be folded over the outer back so as to lie between the outer back of the garment and the second surface 32 of flap 28. When separable fastener portions 42 and 44 are engaged in this second position of flap 28, the garment is effectively transformed into a self contained package having the shape of a cushion, as shown in FIG. 6.

As a further feature of the garment 10 of this invention, a conventional back pack assembly 54 is separably or integrally attached directly to the exterior back surface 22 of the garment in any suitable known manner. Assembly 54 may be positioned conveniently to occupy a conventional wearing position relative to the back of a wearer. When the garment is being worn, back pack assembly 54 may be used in the conventional manner. In accordance with the invention, a third mating fastener half portion 46 is mounted to outer surface 22 of back portion 12, adjacent the periphery of back pack assembly 54. First fastener half-portion 42 is engageable selectively with either one of fastener half-section 44 or half section 46. It should be recognized that third fastener half section 46 is substantially identical to second half-section 44 so that half section 42 may be mated selectively with either one of half-sections 44, 46.

Figure 7:
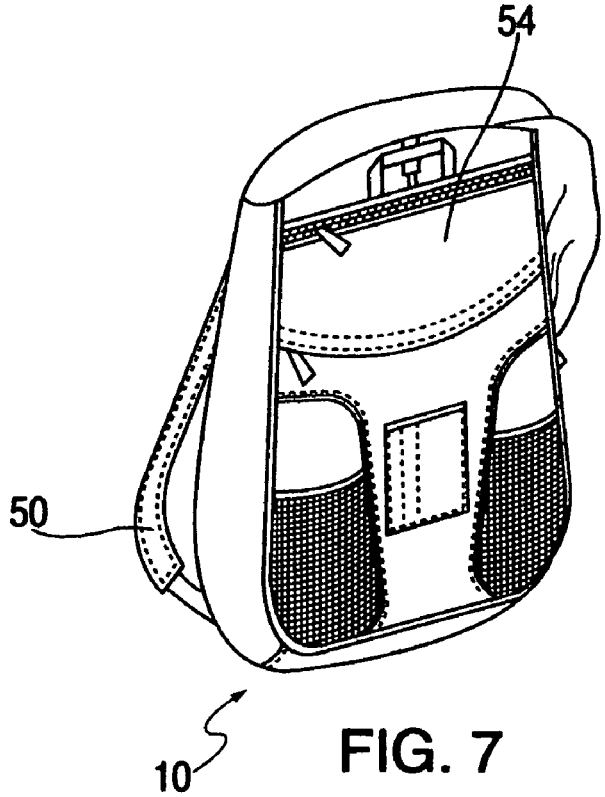
FIG. 7 is a pictorial representation of the garment of FIG. 1 substantially fully transformed into a wearable back-pack structure with the structural body elements of the garment substantially fully enclosed between the inner flap and the inner back of the garment.
Figure 8:
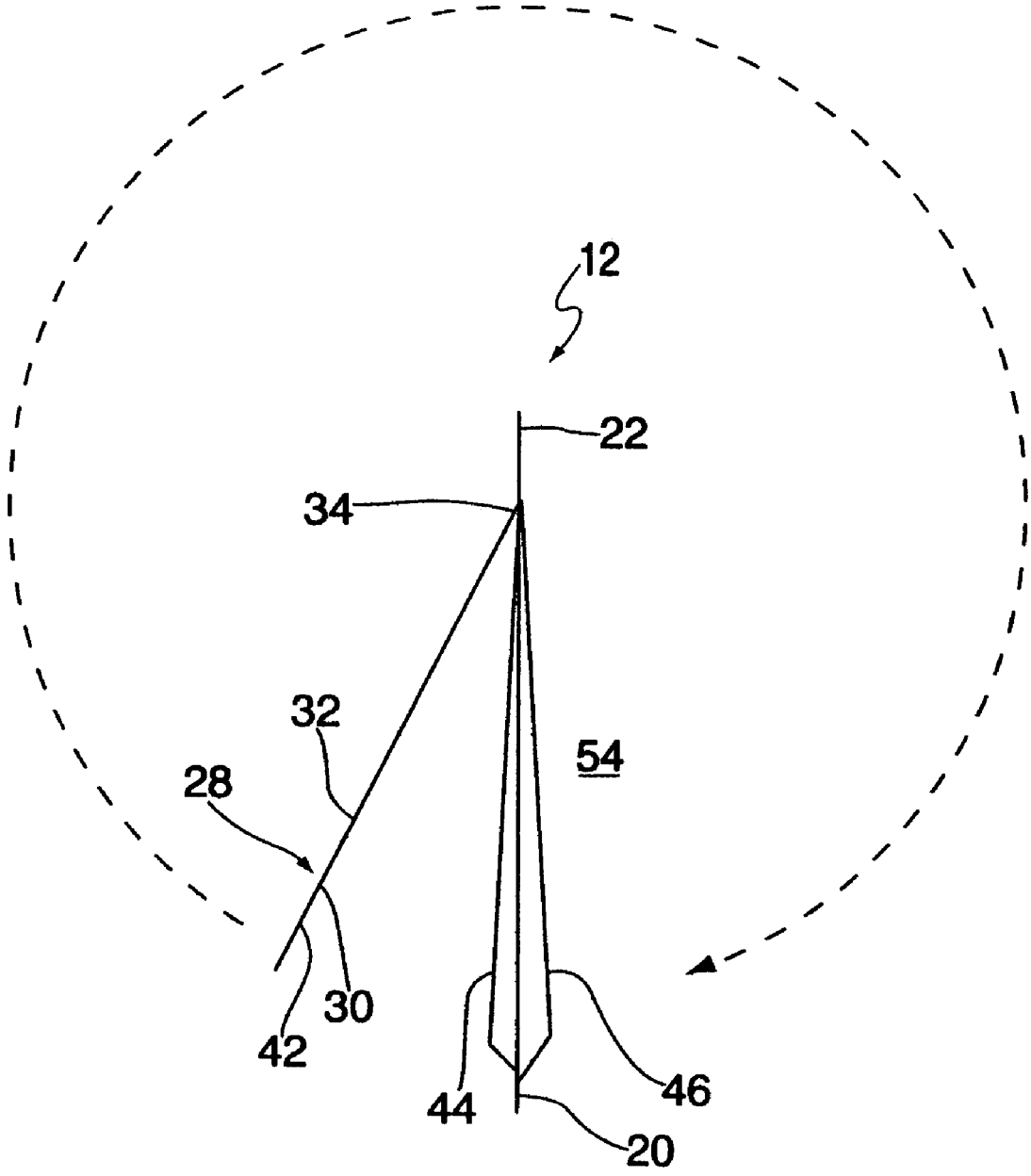
FIG. 8 is a schematic center section view of the garment of FIG. 2, taken along line A-A of FIG. 4.
Figure 9:
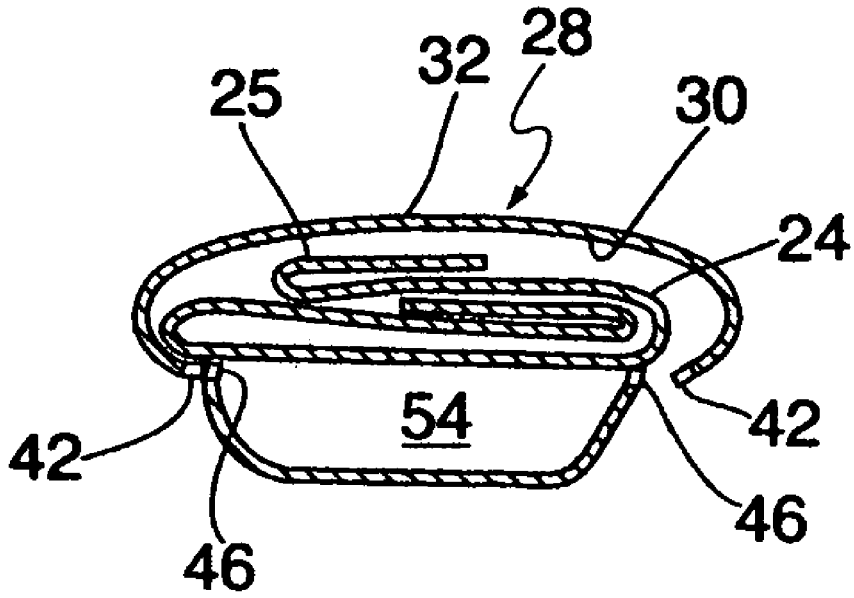
FIG. 9 is a schematic transverse section view of the garment of FIG. 7 showing how the back, flap and bulk of the garment are disposed when the garment has been transformed into a wearable back pack.

As is most evident in FIGS. 8, 9 and 10, flap member 28 may be disposed in the first position, with flap surface 30 in opposed relationship with inner surface 20 of back portion 12, and fastener half-section 42 may be engaged readily with fastener half-section 44, so as to secure the flap 28 in its out-of-the-way position abutting the inner back surface of the garment. In this position, the defined enclosure pocket may contain one or more retaining straps 50 [see FIG. 3], where they are stored until they are required for the wearing of back-pack 54. In FIG. 1, back pack 54 is shown in its preferred position mounted to the outer back surface 22 of garment 10. In FIG. 7, back pack assembly 54 is shown as it appears when the jacket has been transformed in a self-contained wearable pack and the remaining elements of the garment are in concealed storage.

While flap 28 lies in its first position, fastener portion 42 may be engaged as previously described, with fastener portion 44, or, alternatively, fastener portion 42 may be engaged with fastener half-section 46 on the outer back surface 22 of back garment 12; this is accomplished by first folding the bulk of the garment structure, e.g. first and second side portions 24, 25, and arms 11, into the interior of the garment so that they lie over and within the confines outlined by fastener half section 44 abutting inner back surface 20, as indicated schematically in FIG. 9. In this position, the bulk of the garment structure is stored within the "pocket" enclosure defined by surface 30 of flap 28 and the inner surface 20 of garment 10 when fastener half-section 42 is mated with fastener half-section 46. When faster halves 42 and 46 are engaged in this manner, fastener half-section 44 is stored or enclosed within the pocket. Now, as shown in FIG. 7, substantially conventional back-pack structure 54 alone, remains exposed, with the bulk of the garment structure confined within the "pocket" defined between flap 28 and inner back surface 20.

Figure 2:
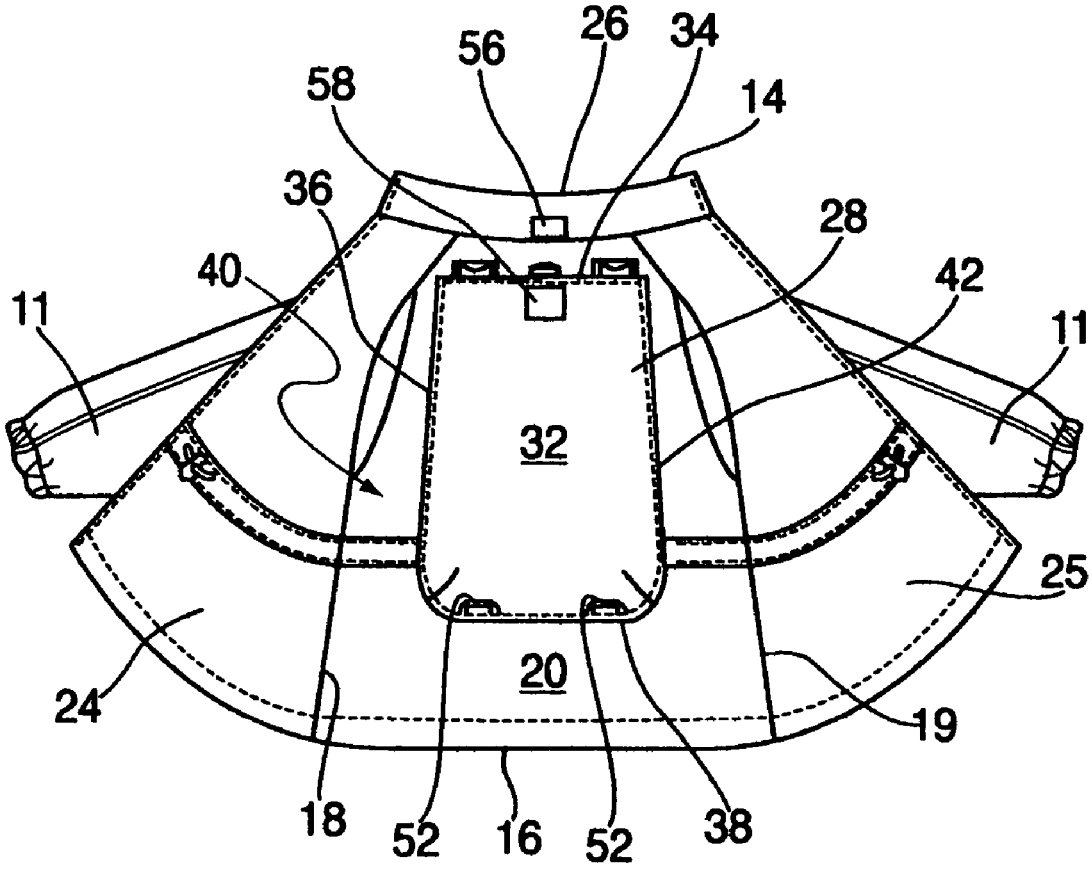
FIG. 2 is a front pictorial view of the garment of FIG. 1 in its open condition, showing the interior of the garment with the fabric flap in its first position.

Those skilled in the art will recognize readily that the garment structure forming neck opening 26 will remain external to the enclosure defined by flap 28 and back surface 20 when the garment 10 has been transformed into a self-contained back pack as described above. However, it will also be recognized that this arrangement, if found undesirable or objectionable for any reason, may be overcome readily by mounting a separable fastener part 56 such as a small snap fastener or a small area of hook-and-loop fastener on the inner surface of neck structure 28, and mounting a mating fastener part 58 at an appropriate location nearby on surface 32 of flap 28, as shown in FIG. 2, to secure the neck structure in a desired "folded-over" condition when the garment is being used in its self-contained back pack configuration.

Figure 3:
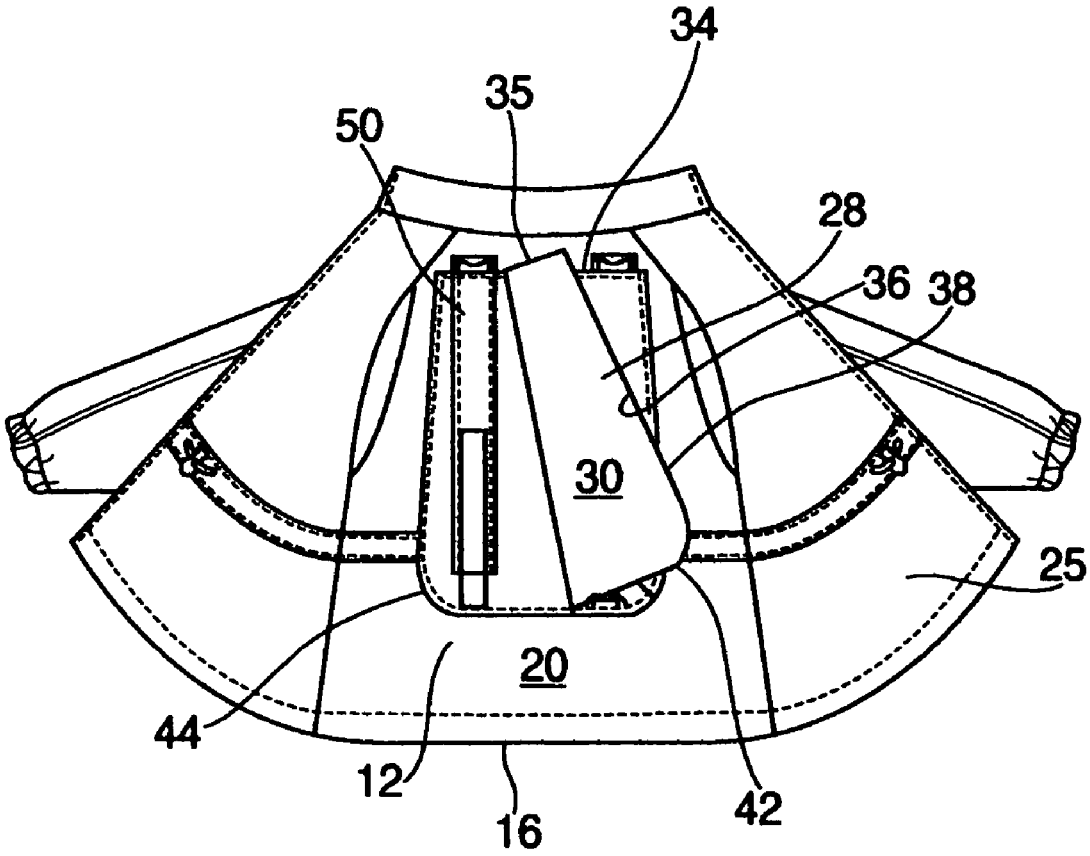
FIG. 3 shows the garment of FIG. 1 from the same pictorial perspective as FIG. 2, but with the interior fabric flap shown partially unfastened and further showing details of a carry strap in position beneath the flap.
Figure 4:
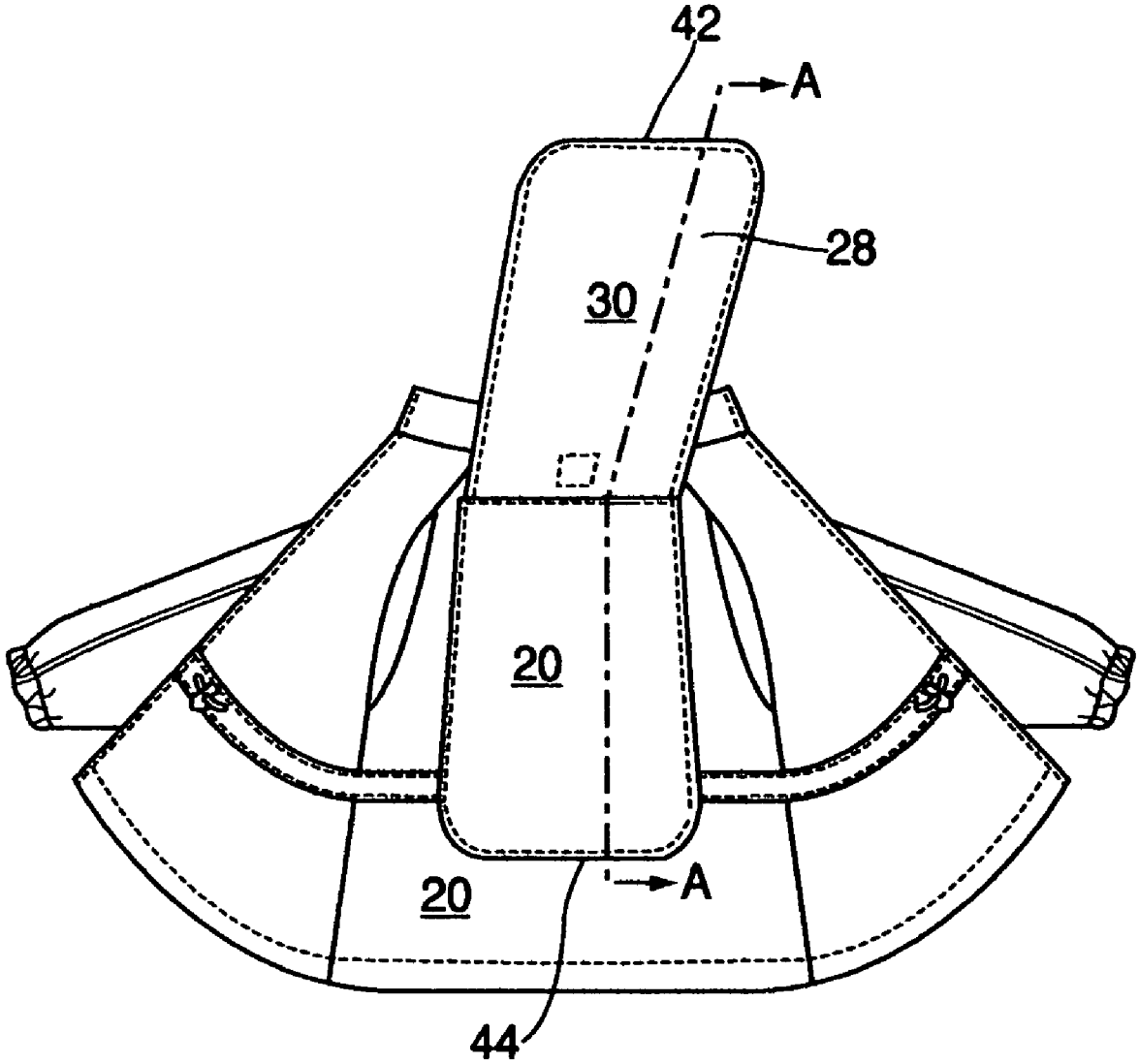
FIG. 4 is a further pictorial representation of FIG. 3 showing the interior flap fully unfastened and partially displaced toward the outside of the garment.
Figure 5:
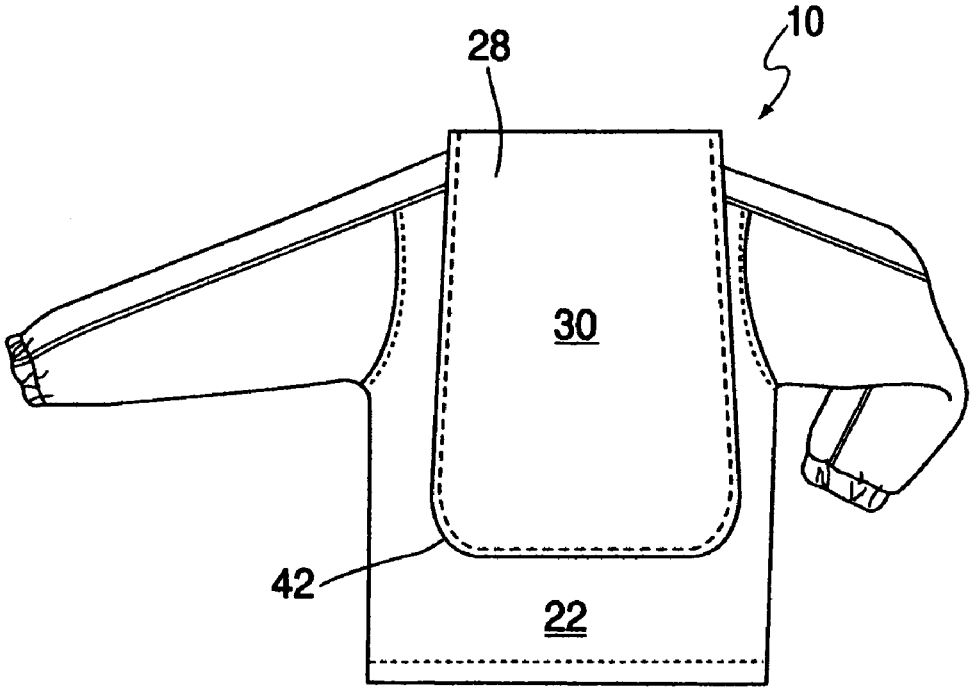
FIG. 5—is a further pictorial representation of FIG. 1, showing the garment with the interior flap displaced toward opposing relationship with the outer back of the garment in position to begin transformation of the garment into a cushion-like package.

Referring now, again, to FIG. 3, the function of "open" portions 35 on the periphery 36 of flap 28 can be understood with reference to retaining straps 50, mentioned previously herein. That is, straps 50, which are provided for the purpose of wearing back-pack 54, are allowed to extend to the exterior of the "pocket" through open portions 35 when the bulk of the garment is enclosed within the pocket and fastener half 42 is engaged to fastener half 46. To further facilitate the use of straps 50 for the wearing of back pack in substantially conventional manner, garment 10 may be provided with receiving loops 52 or buckles to receive and engage the free ends 51 of straps 50. In FIG. 3, loops 52 are shown mounted to surface 32 of flap 28, but it should be understood that such anchoring points for straps 50 may be provided in any suitable manner at any suitable location.

To further explain the "transformation" ability of the garment of this invention, FIG. 6 illustrates how the garment is transformed into a self-contained "cushion" configuration, permitting the transformed garment to be used for sleeping or for the seating of younger wearers on ordinary chairs and the like. For this purpose, flap 28 is disengaged [separated] from inner surface fastener portion 44 and is hinged about hinge element 34 substantially 360 degrees until it overlies outer surface 22 of back portion 12. In this position, the flap will overlie back-pack member 54, if a back-pack is included as part of the garment. Further, the bulk of the garment structure e.g. sleeves 11 and first and second side portions 24, 25 together with any associated structural material, may now be folded rearwardly onto the exterior of the garment so that they lie over and within the confines outlined by fastener half section 46, as indicated schematically in FIG. 10. In this arrangement, fastener half section 42 on flap 28 may be engaged with half-section 44 on the inner surface 20 of back 12 as shown schematically in FIG. 10. Accordingly, a self-contained cushion is formed as shown in FIG. 6, with the primary exposed surfaces of the cushion being inner surface 30 of flap 28 and inner surface 20 of back 12. These two now-exposed surfaces, which are not exposed directly in any other configuration of the garment, may be treated or configured, if desired, to have an appropriate pleasing character such as a soft texture or a pattern to enhance the cushion function. It can be seen easily that the "contents" of the cushion thus defined comprise the back pack assembly 50, if present, and the bulk of the garment structure, characterized above.

Although a preferred embodiment of the method and apparatus of this invention has been illustrated and described, those having skill in this art will recognize that various other forms and embodiments now may be envisioned readily without departing significantly from the spirit and scope of the invention disclosed herein and set forth in the accompanying claims.

The invention claimed is:

1. A wearable and transformable upper torso outerwear garment, comprising a garment back portion formed of fabric, said back portion having an inner surface and an outer surface;

a plurality of garment structural portions attached to and extending from said back portion;

a fabric flap member having a first surface and a second surface and an outer peripheral edge, said flap member being hingedly attached to said inner surface of said back portion proximate a first edge portion of said outer peripheral edge;

said fabric flap member being hingedly displaceable between a first position, in which said first surface of said flap member is disposed in opposed relationship with said inner surface of said back portion, and a second position, in which said second surface of said flap member is disposed in opposed relationship with said outer surface of said back portion;

a first separable fastener half-portion attached to the periphery of said fabric flap member;

a second separable fastener half-portion attached to said inner surface of said back portion, said first separable fastener half-portion being separably engageable with said second separable fastener half-portion when said flap member is in said first position, so as to fasten said flap member in said first position;

a third separable fastener half-portion attached to said outer surface of said back portion, said first separable fastener half-portion being separably engageable with said third separable fastener half-portion when said flap member is in said first position to secure said flap member in said first position;

said first separable fastener half-portion further being separably engageable with said second separable fastener half-portion when said flap member is in said second position, so as to fasten said flap member in said second position.

2. The transformable upper torso outerwear garment of claim 1, further comprising:

a backpack assembly attached to said outer surface of said back portion for use as a backpack by a wearer of said garment.

3. The transformable upper torso outerwear garment of claim 2, wherein:

said first separable fastener half-portion is engage able with said second separable fastener half-portion when said plurality of garment structural portions are folded into overlying relationship with said backpack assembly so as to capture said garment structural portions and said back pack assembly in interposed relationship between said outer surface of said back portion and said second surface of said flap member.

4. The transformable upper torso outerwear garment of claim 3, further comprising:

at least one flexible carrying strap member having one end thereof attached to said back portion, said strap member being flexibly displaceable from a storage position to a carrying position, wherein in said storage position said carrying strap is disposed in the space between said inner surface of said back portion and said first surface of said flap member, and in said carrying position said carrying strap is disposed outside said space between said inner surface of said back portion and said first surface of said flap member so as to be accessible to a user for carrying said back pack assembly.

5. The transformable upper torso outerwear garment of claim 4, further comprising:

at least one open portion in the periphery of said flap member allowing said flexible carrying strap member to extend from said storage position to said carrying position.

6. The transformable upper torso outerwear garment of claim 1, wherein:

said first separable fastener half-portion is engageable with said third separable fastener half-portion when said plurality of garment structural portions are folded into overlying relationship with said inner surface of said back portion so as to capture said garment structural portions in interposed relationship between said inner surface of said back portion and said first surface of said flap member.

7. The transformable upper torso outerwear garment of claim 1, wherein:

said first separable fastener half-portion is engageable with said second separable fastener half-portion when said plurality of garment structural portions are folded into overlying relationship with said outer surface of said back portion so as to capture said garment structural portions in interposed relationship between said outer surface of said back portion and said second surface of said flap member.

8. The transformable upper torso outerwear garment of claim 1, wherein:

at least one of said inner surface of said back portion and said second surface of said fabric flap member are characterized by a distinctive surface texture to enhance use as a cushion.

* * * * *